United States Patent [19]

Adachi et al.

[11] 4,206,676

[45] Jun. 10, 1980

[54] ELECTRONIC MUSICAL INSTRUMENT WITH SEQUENCER FOR AUTOMATIC ARPEGGIO PERFORMANCE

[75] Inventors: Takeshi Adachi; Masahiko Koike; Haruyuki Suzuki, all of Hamamatsu, Japan

[73] Assignee: Nippon Gakki Seizo Kabushiki Kaisha, Hamamatsu, Japan

[21] Appl. No.: 911,396

[22] Filed: Jun. 1, 1978

[30] Foreign Application Priority Data

| | | | |
|---|---|---|---|
| Jun. 3, 1977 | [JP] | Japan | 52-65530 |
| Jun. 8, 1977 | [JP] | Japan | 52-74642[U] |
| Jun. 8, 1977 | [JP] | Japan | 52-74643[U] |
| Jun. 8, 1977 | [JP] | Japan | 52-74644[U] |

[51] Int. Cl.[2] ..... G10H 1/02

[52] U.S. Cl. ..... 84/1.03; 84/1.24; 84/DIG. 22; 84/DIG. 12

[58] Field of Search ..... 84/1.01, 1.03, 1.24, 84/1.27, DIG. 22, DIG. 12

[56] References Cited

U.S. PATENT DOCUMENTS

| | | | |
|---|---|---|---|
| 3,795,755 | 3/1974 | Uchiyama | 84/1.03 |
| 3,952,624 | 4/1976 | Kawakami | 84/1.27 |
| 3,978,754 | 9/1976 | Adachi | 84/1.27 |
| 3,986,426 | 10/1976 | Faulhaber | 84/1.27 |
| 3,999,458 | 12/1976 | Suzuki | 84/1.24 |

*Primary Examiner*—Gene Z. Rubinson
*Assistant Examiner*—William L. Feeney
*Attorney, Agent, or Firm*—Frishauf, Holtz, Goodman & Woodward

[57] ABSTRACT

An electronic musical instrument is provided with a keyboard circuit, a voltage-controlled tone signal generating circuit arrangement and a sequencer for sequentially coupling memorized pitch voltage signals to the voltage-controlled tone signal generating circuit arrangement, thereby realizing automatic arpeggio performance. The sequencer is so connected as to receive a pitch determining voltage signal from the keyboard circuit at a given timing and is so arranged that the magnitudes of pitch voltage signals coupled to the tone signal generating circuit arrangement are shifted in accordance with the pitch determining voltage signal from the keyboard circuit, thus achieving transposition of arpeggio.

22 Claims, 5 Drawing Figures

OUTPUT (MV)
TR
DRIVERS
SEQUENTIAL PULSE GEN.
RESET
TIME CHANGER
DELAY
ONE-SHOT MULTI.
SEQUENCER "0"
TIME CHANGER
DRIVER
VCO
AUTO/MANUAL MODE SELECT SW.
START/STOP CONTROL SW.
KV
+V (+2V)

ELECTRONIC MUSICAL INSTRUMENT WITH SEQUENCER FOR AUTOMATIC ARPEGGIO PERFORMANCE

BACKGROUND OF THE INVENTION

The present invention relates to an electronic musical instrument and, more particularly, to an electronic musical instrument with a sequencer for automatic arpeggio performance.

It is very difficult for beginners to play arpeggio or broken chord, i.e. play the notes of a chord in quick succession instead of simultaneously. It is desired, therefore, that an electronic musical instrument be provided with a sequencer enabling the arpeggio or broken chord to be automatically played.

FIG. 1 shows a basic construction of a conventional electronic musical instrument incorporated with such a sequencer. In FIG. 1, reference numeral 11 is a frequency-variable clock pulse generator for generating clock pulses with a frequency corresponding to the tempo of a musical composition being performed. The output clock pulse of the clock pulse generator 11 is applied to a sequential pulse generator 12 to which a start/stop control switch 13 is operatively coupled, and causes the pulse generator 12 being enabled by the switch 13 to produce sequentially and circulatingly output pulses at the outputs thereof. The output pulses of the sequential pulse generator 12 are applied to the control inputs of a plurality of gates 14, respectively. A pitch voltage setting circuit 15 including a plurality of potentiometers connected across a DC power source applies a plurality of pitch voltage signals (referred to as MV signals) memorized (prepared) in the pitch voltage setting circuit 15 to the inputs of the gates 14. Upon receipt of the output pulses from the sequential pulse generating circuit 12, the gates 14 are sequentially and circulatingly enabled to allow the memorized MV signals to be read out sequentially (usually one after another) and repeatedly on commonly connected outputs of the gates 14. The MV signals in serial form from the gates 14 are applied to a voltage-controlled frequency-variable oscillator (hereinafter referred to as VCO) 16. The VCO 16 sequentially produces tone signals with frequencies corresponding to the magnitudes (D.C. voltage values) of the MV signals. The tone signals from the VCO 16 are in turn applied to a voltage-controlled cutoff-frequency-variable filter (hereinafter referred to as VCF) 17 and a voltage-controlled gain-variable amplifier (hereinafter referred to as VCA) 18. Control waveform generators (CWG) 21 and 22, which are triggered by the clock pulses to produce time-varying control waveform signals, are connected to VCF 17 and VCA 18, respectively, and controls the tone color and amplitude envelope of a tone signal being produced in accordance with the shapes of the time-varying control waveform signals. The musical tone signals from VCA 19 are applied to a sound system including an amplifier 19 and a loudspeaker 20 to sequentially sound tones as memorized in the pitch voltage setting circuit 15.

In the above-mentioned apparatus, the MV signals set in the pitch voltage setting circuit 15 are sequentially applied to the VCO 16 through the gates 14 so that arpeggio, broken chord or the like is automatically performed. Although very similar, the distinction between arpeggio and broken chord depends on pitch voltage setting states in the pitch voltage setting circuit 15, so to speak. In other words, the distinction depends on the notes of tones to be stored in the pitch voltage setting circuit 15 and the order of read-out of the tones stored, i.e. a note pattern memorized. The note pattern is set by a player. The tempo in the performance of the arpeggio or broken chord is adjustable by changing the oscillating frequency of the clock pulse generator 11.

The automatic performance of the arpeggio or broken chord is intended to accompany a keyboard performance by a player; however, the circuits relating to the keyboard performance are omitted in FIG. 1. In the above-mentioned sequencer, the pitch voltages memorized in the pitch voltage setting circuit 15 are fixed. For this reason, it is impossible to change the pitches of the tones to be automatically played during the performance of a musical composition. Therefore, the application of the sequencer is restricted to a specific use.

In the apparatus in FIG. 1, it is necessary to set pitch voltage in the pitch voltage setting circuit prior to a performance. Accordingly, the apparatus is provided with a manual advance switch (not shown) for manually advancing, step by step, the sequential pulse generator. However, provision of the start/stop control switch and the manual advance switch on the control panel of an electronic musical instrument results in complexity of the panel face and high cost.

SUMMARY OF THE INVENTION

Accordingly, an object of the invention is to provide an improved sequencer for automatic performance of arpeggio or broken chord.

Another object of the invention is to provide an electronic musical instrument with a sequencer having means for changing the pitches of tones to be automatically played in accordance with the manual performance of a musical composition on the keyboard.

Still another object of the invention is to provide an electronic musical instrument with a sequencer having an auto/manual mode selection control circuit simple in construction.

A sequencer, according to this invention, for sequentially applying memorized pitch voltage signals to a voltage-controlled tone signal generating circuit arrangement comprises: a voltage-controlled tone signal generating circuit arrangement for generating a tone signal having a tone pitch which is determined by a voltage value of a signal applied thereto as its control signal; clock pulse generating means; sequential pulse generating circuit means for sequentially and circulatingly generating, in response to clock pulses from the clock pulse generating means, a plurality of output pulses on a plurality of outputs thereof; a plurality of gate circuit means which are enabled by the sequential output pulses from the sequential pulse generating means, respectively and whose outputs are connected commonly to the voltage-controlled tone signal generating circuit arrangement; and pitch voltage setting circuit means for applying memorized pitch voltage signals to the inputs of the gate circuit means, respectively, the pitch voltage setting circuit being arranged such that the magnitudes (D.C. voltage values) of the pitch voltage signals coupled to the gate circuit means are shifted in accordance with the magnitude (D.C. voltage value) of a reference voltage signal externally applied thereto.

In a preferred embodiment, the pitch voltage setting circuit means comprises potentiometers which are connected in parallel with each other and whose sliders are connected to the inputs of the gate circuit means, respectively, and an operational amplifier having an output connected to the potentiometers and a first input connected to the slider of one of the potentiometers. The operational amplifier is connected to receive at the second input a voltage signal selected from a plurality of voltage signals with different magnitudes and originated from means such as a keyboard circuit. The selected voltage signal serves as a reference signal. The reference signal is coupled to the second input of the operational amplifier through a sample/hold circuit which is enabled by one of output signals from the sequential pulse generating circuit means. With such a circuit construction, the pitch voltages from the pitch voltage setting circuit to be coupled with the gate circuit means have magnitudes depending on the magnitude of the reference signal. One of the pitch voltages, i.e. the slider voltage of the potentiometer coupled with the first input of the operational amplifier, is equal in magnitude to the reference voltage. Therefore, the memorized tones corresponding to the pitch voltages set in the pitch voltage setting circuit means are shifted every time the magnitude of the reference voltage signal changes.

The sequencer of the invention preferably has an auto/manual mode selection control circuit simple in construction. This control circuit includes an auto/-manual mode selection switch, a start/stop control switch and a control circuit means. The control circuit means couples the clock pulses generated from the clock pulse generating means to the sequential pulse generating circuit means in response to the auto mode selection by means of the auto/manual mode selection switch and a subsequent operation of the start/stop control switch. In response to the manual mode selection by the auto/manual mode selection switch and succeeding repetitive operations of the start/stop control switch, the control circuit means also supplies an advance pulse to the sequential pulse generating means every time the start/stop control switch is operated. In the above control circuit the start/stop control switch can be used as a switch for manually advancing the sequential pulse generating circuit means.

DESCRIPTION OF THE PREFERRED EMBODIMENTS

Figure 1:
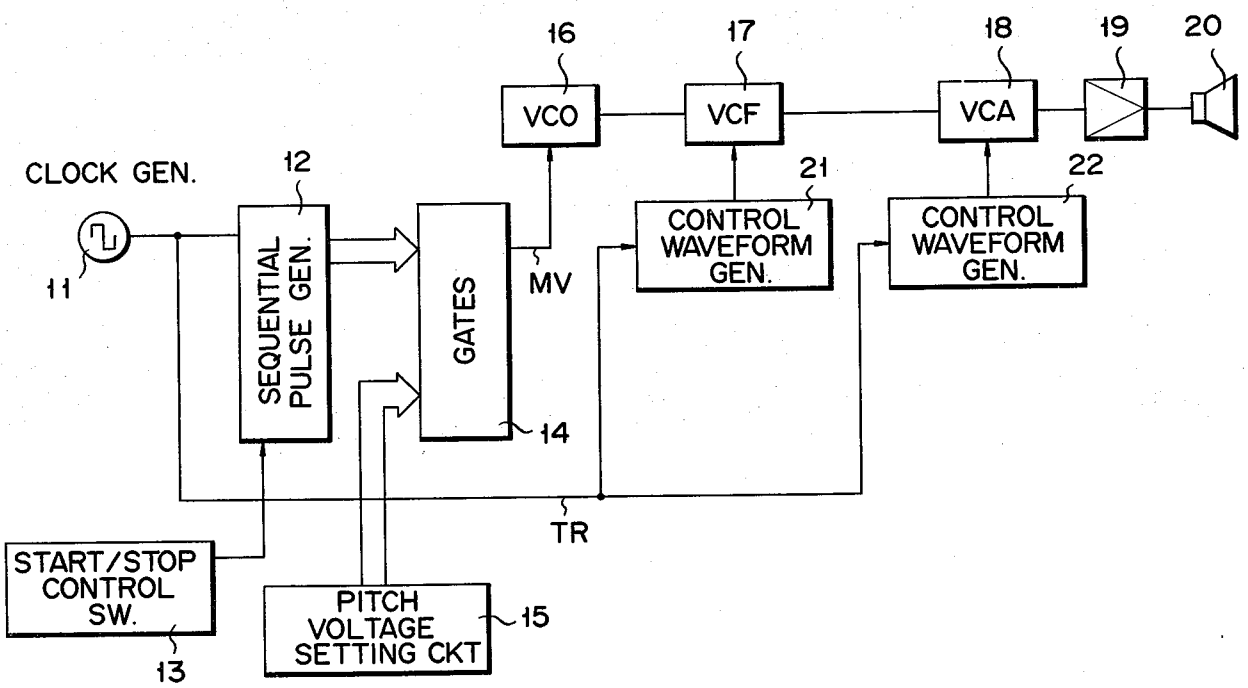
FIG. 1 PRIOR ART
FIG. 1 shows a block diagram illustrating a basic construction of a conventional electronic musical instrument incorporated with a sequencer.
Figure 2:
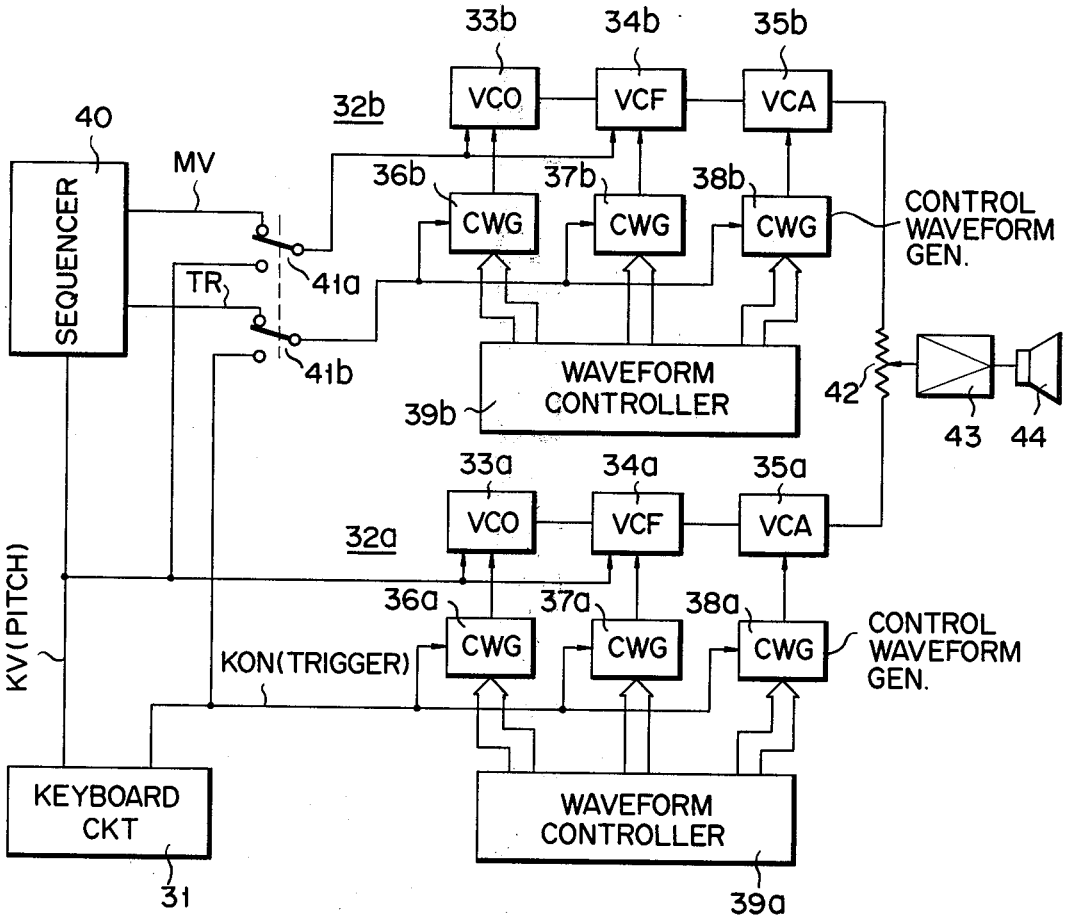
FIG. 2 shows a block diagram of an electronic musical instrument with a sequencer according to the invention.

In FIG. 2 illustrating an embodiment of an electronic musical instrument according to the invention, reference numeral 31 designates a keyboard circuit with a plurality of keys which provides a pitch determining voltage signal (referred to as KV signal) and a key depression representative signal (referred to as KON signal). The KV signal has a magnitude corresponding to the note of a selectively depressed key of plural keys.

The KV and KON signals are coupled to a first voltage-controlled tone signal generating circuit arrangement **32*a*. As is known, the circuit arrangement 32*a* is provided with VCO 33*a*, VCF 34*a* and VCA 35*a* and produces a tone signal corresponding to the magnitude of the KV signal supplied to the VCO 33*a*, i.e. the note of a key depressed. The KV signal is also coupled to VCF 34*a*. Upon receipt of the KV signal, VCF 34*a* is caused to have a cutoff frequency corresponding to the magnitude of the KV signal. VCO 33*a*, VCF 34*a* and VCA 35*a* are coupled to control waveform generators 36*a*, 37*a* and 38*a*, respectively, which are triggered by the KON signal to produce time-varying control waveform signals. Accordingly, the voltage-controlled tone signal generating circuit arrangement 32*a* produces a musical tone signal whose tone pitch, tone color and amplitude envelope vary with time. Each time-varying control waveform signal has controllable parameters for defining the shape thereof. For this reason, a waveform controller 39*a*** is provided for coupling parameter controlling voltage signals to the corresponding control waveform generators to produce desired shapes of control waveform signals.

Reference numeral 40 designates a sequencer according to the invention in which a plurality of MV signals are memorized. The sequencer will be described in detail later. In brief, the sequencer is so arranged as to receive a KV signal from the keyboard circuit 31 at a given timing, sequentially read out the MV signals with the magnitudes proportional to that of the KV signal, and produce a trigger signal (TR) at the timing of readout of each MV signal. One of the MV signals read out is equal in magnitude to the KV signal.

The electronic musical instrument in FIG. 2 further includes a second voltage-controlled tone signal generating circuit arrangement **32*b* which is selectively connected to the keyboard circuit 31 and the sequencer 40 through keyboard/sequencer selection switches 41*a* and 41*b*. The second voltage-controlled tone signal generating circuit arrangement 32*b* is comprised of VCO 33*b*, VCF 34*b* and VCA 35*b*, control waveform generators 36*b*, 37*b* and 38*b*, and a waveform controller 39*b*, like the first circuit arrangement 32*a*. The keyboard/sequencer selection switch 41*a* is adapted to couple the KV signal from the keyboard circuit 31 or the MV signals from the sequencer 40 to the VCO 33*b* and VCF 34*b*. The other switch 41*b* is adapted to couple the KON signal from the keyboard 31 or the TR signals from the sequencer 40 to the control waveform generators 36*b*, 37*b* and 38*b***.

The output tone signals from the VCAs **35*a* and 25*b* are mixed by a mixer 42 and then are applied to a sound system including an amplifier 43 and a loudspeaker 44 thereby to sound musical tones. The mixer 42 may be constructed by a potentiometer as shown so as to couple to the sound system the output signals from the first and second circuit arrangements 32*a* and 32*b*** in a variable mixing ratio.

The VCOs **33*a* and 33*b* may be so constructed that they are tuned or detuned with respect to each other for a common KV signal by means not shown. VCAs 35*a* and 35*b*** are enabled by the control waveforms coupled thereto to permit input signals to pass therethrough, but they may be so constructed as to be enabled normally by means not shown.

Figure 3:
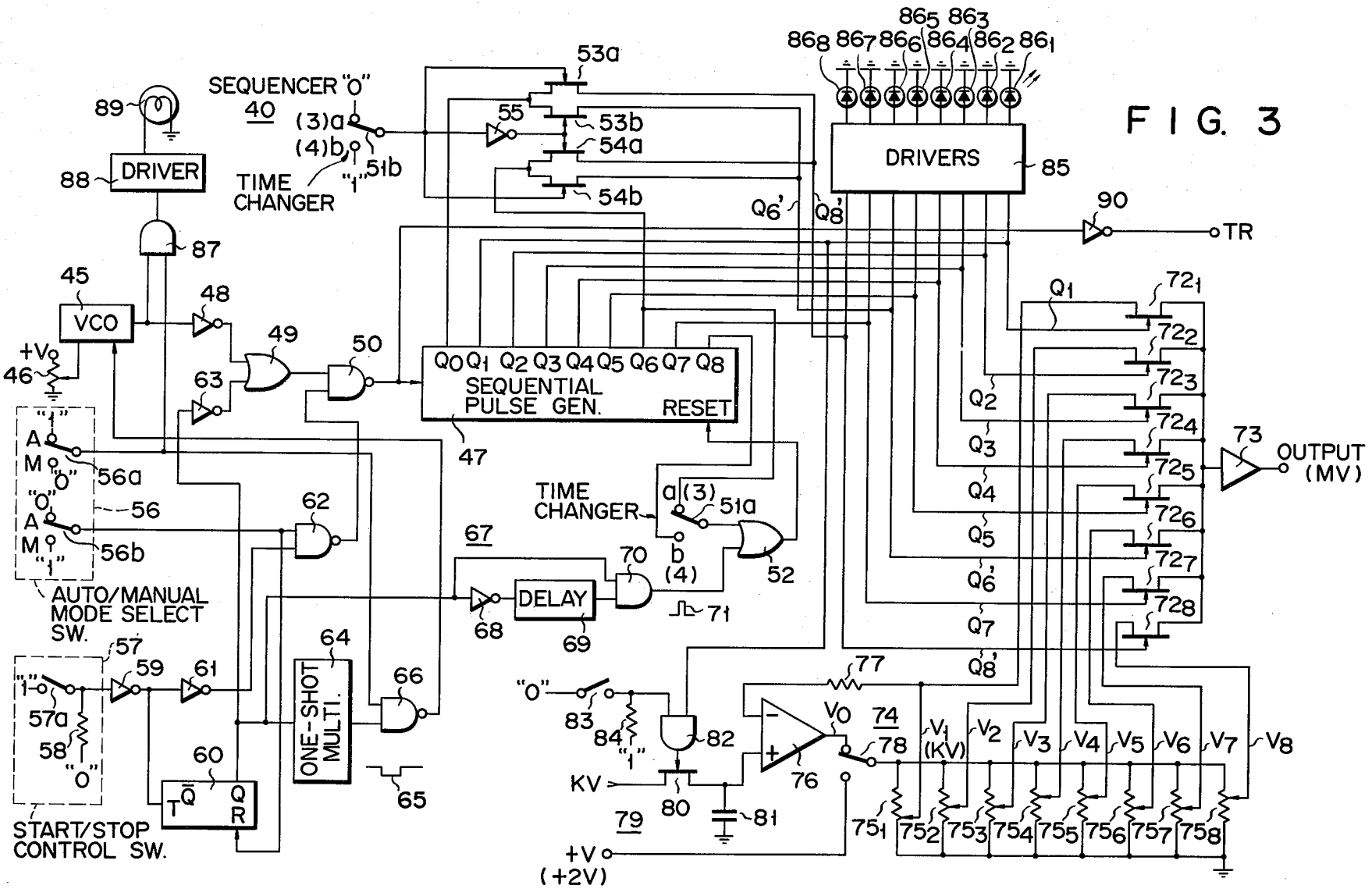
FIG. 3 shows a circuit diagram of the sequencer in FIG. 2.

A construction of the sequencer 40 will be described with reference to FIG. 3. In the figure, reference numeral 45 designates a voltage-controlled frequency-variable oscillator for generating tempo setting clock pulses. The oscillator 40 is connected at the control input thereof to an oscillating frequency control potentiometer 46 connected to a DC power source. The variable frequency range of the oscillator 45 is typically 0.25 to 50 Hz.

Figure 4A:
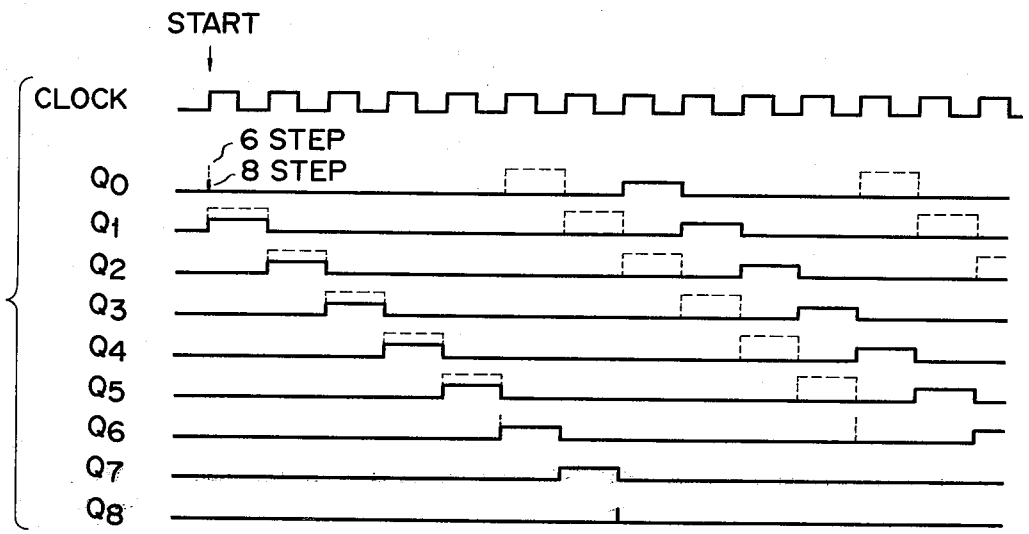
FIGS. 4A and 4B show sets of waveforms of the sequential output pulses of the sequential pulse generating circuit and the gating pulses applied to the gate circuit.

The clock pulses from the VCO 45 are applied to a sequential pulse generator 47 through an inverter 48, an OR gate 49 and a NAND gate 50. The sequential pulse generator 47 is provided with a plurality of outputs and, in response to the clock pulses applied thereto, produces output pulses on the outputs sequentially and circulatingly. The sequential pulse generator 47 preferably produces the sequential output pulses the number of which is a multiple of 4. In the figure, the sequential pulse generator 47 is provided with the outputs Q0 to Q8 and produces sequential pulses of eight steps. The generator 47 is also controlled so as to produce 6- or 8-step sequential pulses. For this reason, the outputs Q6 and Q8 are coupled with the fixed contacts a and b of a first time-changing switch 51*a*, respectively, to be selectively connected to the reset terminal (RESET) of the sequential pulse generator 47 through an OR gate 52. When a triple time is set, the output Q6 is coupled to the reset terminal and, as soon as the output pulse appears at the output Q6, the sequential pulse generating circuit 47 is reset to an initial state so as to produce an output pulse at the output Q0. When a quadruple time is selected, the output Q8 is coupled to the reset terminal and, the instant the output pulse appears on the output Q8, the sequential pulse generator 47 is reset. As a result, at the settings of a triple time and a quadruple time, 6- and 8-step output pulses are sequentially and circulatingly produced. The relation between the input clock pulses of the sequential pulse generating circuit 47 and the outputs Q0 to Q8 is illustrated in FIG. 4A. A commercially available integrated circuit may be used for the sequential pulse generating circuit.

Figure 4B:
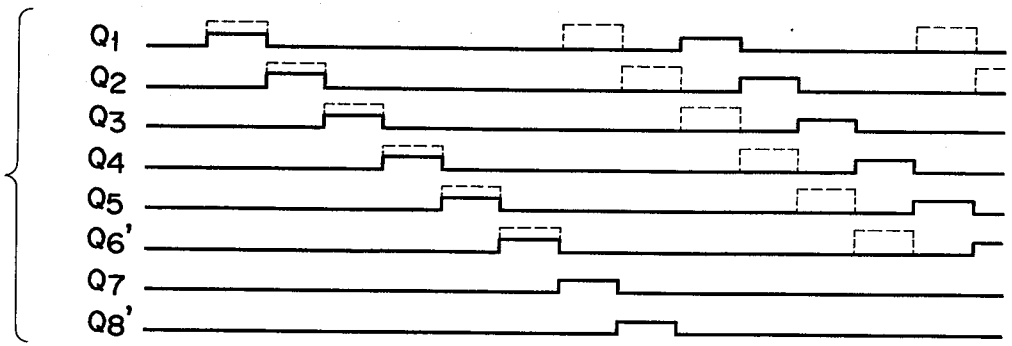

A second time-changing switch 51*b* is provided interlocking with the first switch 51*a*. The fixed contact a of the switch 51*b* corresponding to triple time is coupled to a logical 0 level source and the fixed contact b corresponding to quadruple time to a logical 1 level source. The switch 51*b* is connected at the output thereof to the control inputs of gates 53*a* and 54*b* directly and the control inputs of gates 53*b* and 54*a* through an inverter 55. In the figure, the gates 53*a*, 53*b*, 54*a* and 54*b* are each formed by an N-channel field effect transistor. Accordingly, when the output signal of the switch 51*b* is at a logical 0 level in positive logic system (when triple time is set), the gates 53*b* and 54*a* are enabled while the gates 53*a* and 54*b* are disabled. On the other hand, when the output signal of the switch 51*b* is at a logical 1 level (at the setting of quadruple time), the gates 53*a* and 54*b* are enabled while the gates 53*b* and 54*a* are disabled. The output Q0 of the sequential pulse generating circuit 47 are coupled to the inputs of the gates 53*a* and 53*b* and the output Q6 is coupled to the gates 54*a* and 54*b*. The outputs of gates 53*a* and 54*a* are connected to each other to form an output Q'8. The outputs of gates 53*b* and 54*b* are connected to each other to form an output Q'6. The outputs Q'8 and Q'6, together with the outputs Q1 to Q5 and Q7 of the sequential pulse generating circuit 47, are used as gating signals for gate circuits to be described later. The time chart of gating pulses for triple time and quadruple time settings is illustrated in FIG. 4B.

The embodiment further includes an auto/manual mode selection switch circuit 56 and a start/stop operation control switch circuit 57. As shown, the auto/-manual mode selection switch circuit 56 is comprised of first and second single-pole double-throw switches 56*a* and 56*b* ganged with each other. The fixed contact A for auto-mode of the first switch 56*a* is connected to a logical 1 level source and the fixed contact M for manual mode to a logical 0 level source. The fixed contact A for auto mode of the second switch 56*b* is connected to a logical 0 level source and the fixed contact M for manual mode to a logical 1 level source. The operation control switch circuit 57 includes a single-pole single-throw switch 57*a* of self-restoring type. The switch 57*a* is connected at the fixed contact to a logical 0 level source via a resistor 58.

The output of operation control switch 57 is coupled with the trigger input T of a T-type negative-edge triggered flip-flop circuit 60 via an inverter 59. The output of the inverter 59 is connected through an inverter 61 to one of the inputs of a NAND gate 62 having an output connected to an input of NAND gate 50. The other input of the NAND gate 62 is coupled to the output of switch 56*b*. The output of switch 56*b* is coupled with the reset input R of flip-flop circuit 60. The output Q of the flip-flop circuit 60 is coupled to OR gate 49 through an inverter 63. The flip-flop circuit 60 is reset by the reset input of a logical 1 level to bring the output Q to logical 0 level. When the reset input R of the flip-flop circuit 60 is at logical 0 level, the flip-flop circuit 60 is responsive to the negative transition at the trigger input T from logical 1 level to 0 level to invert the output Q from logical 1 level to 0 level and vice versa.

The set output Q of flip-flop circuit 60 is coupled to a one-shot multivibrator 64. The multivibrator 64 produces, in response to the positive transition of the output Q of flip-flop circuit 60 from logical 0 level to 1 level, a negative-going pulse 65 with a given duration. The output of the multivibrator 64 is connected to one input of a NAND gate 66 connected at the other input to the output of auto/manual mode selection switch 56*a*. The output of NAND gate 66 is coupled to the disable input of VCO 45. The VCO 45 is disabled when its disable input is at logical 1 level and is enabled when it is at logical 0 level to produce clock pulses.

The output Q of flip-flop circuit 60 is coupled to a reset pulse generating circuit 67 comprising an inverter 68, a delay circuit 69 and an AND gate 70, for generating a reset pulse 71 applied to the sequential pulse generating circuit 47. When the output Q of the flip-flop circuit 60 is switched from logical 0 level to 1 level, i.e. the flip-flop circuit 60 is set, the reset pulse generating circuit 67 produces the reset pulse 71 with a duration corresponding to the delay time of delay circuit 69. The reset pulse 71 is coupled to the reset input of sequential pulse generating circuit 47 through OR gate 52. As will be subsequently described, in the above-mentioned control circuit, the control switch 57*a* also serves as a manual advance switch as well as a start/stop control switch, resulting in simplifying the circuit construction of the control circuit. The auto/manual mode selection switch circuit 56 may be constructed by, for example, the switch 56*a* alone. In this case, the output of the switch 56*b* instead of that of the switch 56*a* may be connected to the NAND gate 66 via in inverter. The operation control switch 57*a* may be constructed by a foot-operated switch.

Eight gate circuits $72_1$ to $72_8$ are provided corresponding to eight sequential pulses at maximum produced by the sequential pulse generating circuit 47. The sequential pulses Q1 to Q5, Q'6, Q7 and Q'8 are applied to the control inputs of gate circuits $72_1$ to $72_8$, respectively. The gate circuits are enabled by logical 1 level control input to transfer input voltage signals applied to inputs to outputs. The outputs of the gate circuits $72_1$ to $72_8$ are commonly connected. The commonly connected outputs of gate circuits $72_1$ to $72_8$ are coupled to the voltage-controlled tone signal generating circuit arrangement 32*b* through a buffer amplifier 73 with a gain of unity. In this example, the gate circuits $72_1$ to $72_8$ are constructed by N-channel field-effect transistors, but are not limited thereto.

A pitch voltage setting circuit 74 is connected to the inputs of gate circuits $72_1$ to $72_8$. The pitch voltage setting circuit 74 is provided with eight potentiometers $75_1$ to $75_8$ whose resistance bodies are connected in parallel to each other with first terminals thereof connected to ground. The sliders of potentiometers $75_1$ to $75_8$ are connected to the inputs of gate circuits $72_1$ to $72_8$, respectively. In the figure, the slider of potentiometer $75_1$ disposed at the leftmost side is coupled to the inverting input of an operational amplifier 76 through a resistor 77. A switch 78 is provided to selectively connect a fixed voltage source (+V) and the output of operational amplifier 76 to second terminals of the parallel connected potentiometers $75_1$ to $75_8$.

The operational amplifier 76 is connected at the noninverting input to a sample/hold circuit 79 which is comprised of a gate 80 enabled at given intervals of time and a storage capacitor 81, and receives KV signal from the keyboard circuit 31. The sample/hold circuit 79 samples the KV signals at a given timing, or the timing of the first beat for one- or two-measure unit of a musical composition being played, and loads a sampled KV signal into capacitor 81. For this reason, to the control input of the gate 58 (in the figure, shown by an N-channel field-effect transistor) is connected the output of an AND gate 82 connected at one input to the output Q1 of sequential pulse generating circuit 47. The other input of AND gate 82 is connected to a logical 0 level source through a manually operable hold switch 83 of self-return type, and is connected via a resistor 84 to a logical 1 level source. Accordingly, when the hold switch 83 is open as shown, the AND gate 82 is enabled and forms a sampling pulse every time the sequential pulse generating circuit 47 produces a pulse on the output Q1, thereby to sample the KV signals. When the hold switch 83 is closed, the AND gate 82 is disabled so that a previously sampled KV signal is stored in the storage capacitor 81.

In the pitch voltage setting circuit 74, the slider of potentiometer $75_1$ is fed back to the inverting input of operational amplifier 76 through resistor 77. Therefore, the output voltage $V_1$ of potentiometer $75_1$ has the magnitude of the KV signal coupled to the noninverting input of the operational amplifier 76. The output voltages $V_2$ to $V_8$ of other potentiometers have magnitudes proportional to that of the KV signal.

The sequential pulses Q1 to Q5, Q'6, Q7 and Q'8 are coupled with a proper driver circuit 85 to successively light indicators $86_1$ to $86_8$ constructed by light-emitting diodes, for example. The indicators $86_1$ to $86_8$ visually indicate which one of gate circuits $72_1$ to $72_8$ is being enabled. Provision of the indicators $86_1$ to $86_8$ assists particularly the pitch voltage setting work, i.e., the pitch setting work of memorized tones in the pitch voltage setting circuit 74 at the manual advance of the sequential pulse generating circuit 47. The tone pitch setting work may be conducted while a player hears tones produced by keyboard operation from the tone signal generating circuit arrangement 32*a* shown in FIG. 2. The setting work is also conducted under a condition that the VCA 35*b* is normally enabled.

In order to visually indicate the auto mode operation, an AND gate 87 is provided whose inputs are connected to the output of VCO 45 and the output of auto/-manual mode selection switch 56*a*. The output of the AND gate 87 is coupled with a driver 88 for lighting an indicator 89.

The input of sequential pulse generating circuit 47 is coupled to control waveform generators 36*b*, 37*b* and 38*b* via an inverter 90 and the switch 41*b* (FIG. 2). The control waveform generators 36*b*, 37*b* and 38*b* produce time-varying control waveforms every time an input pulse is applied to the sequential pulse generator 47, in other words, an MV signal is read out from the sequencer 40.

The operation of the sequencer will be described hereinafter.

First described is the operation when the auto/-manual mode selection switches 56*a* abd 56*b* and the time-change switches 51*a* and 51*b* are positioned as shown in the figure, that is to say, the operation in auto mode and in triple time. In this case, the flip-flop circuit 60 is assumed to be initially reset.

The outputs of switch 56*a* and one-shot multivibrator 64 are at logical 1 level so that the output of NAND gate 66 is at logical 0 level. Accordingly, VCO 45 is enabled to produce clock pulses. However, the output Q of flip-flop circuit 60 is at logical 0 level and thus the output of inverter 63 is at logical 1 level. Therefore, the output of OR gate 49 is at logical 1 level thereby to prevent the clock pulses from VCO 45 from being applied to the sequential pulse generating circuit 47. Upon closure of the operation control switch 57*a*, the trigger input T of flip-flop circuit 60 whose reset input R is at logical 0 level is switched from logical 1 level to 0 level so that the flip-flop circuit 60 is triggered to render the output Q at logical 1 level. As a result, the output of inverter 63 becomes logical 0 level. The one-shot multivibrator 64 is triggered to form the negative-going pulse 65. For the duration of negative-going pulse 65, the output of NAND gate 66 becomes logical 1 level to disable VCO 45. Responsive to the triggering of flip-flop circuit 60, the reset pulse generating circuit 67 forms the reset pulse 71 to reset the sequential pulse generating circuit 47 to the initial state. In the initial state, only the output Q0 is at logical 1 level. Since the output of switch 56*b* is at logical 0 level, the output of NAND gate 62 connected to the NAND gate 50 is at logical 1 level. Accordingly, the output clock pulses of VCO 45 which has been enabled by return of output of the one-shot multivibrator 64 to logical 1 level are applied to the sequential pulse generator 47 through the inverter 48, OR gate 49 and NAND gate 50. That is, the clock pulses from VCO 45 are applied to the sequential pulse generating circuit 47 which has been already reset, after a given time from the operation of the switch 57*a*.

Responsive to the application of clock pulses, the sequential pulse generating circuit 47 produces output pulses. As shown in FIG. 4A, as soon as the output Q6 becomes logical 1 level, the sequential pulse generating circuit 47 is reset so that the output Q0 becomes logical 1 level. The output pulse at the output Q0 is taken out as Q'6 via the gate 53*b* as shown in FIG. 4B.

When a triple time is selected, the sequential pulses Q1 to Q5 and Q'6 are formed circulatingly so that the gate circuits $72_1$ to $72_6$ are sequentially and circulatingly enabled. As a result, the output voltages $V_1$ to $V_6$ of potentiometers $75_1$ to $75_6$ are successively and circulatingly read out so that the tone signal generating circuit arrangement 32*b* produces the tone signals corresponding to the pitch voltages $V_1$ through $V_6$. The tone pitch, tone color and envelope of the tone signal being produced are controlled in accordance with the shapes of the control waveform signals from the control waveform generators 36*b*, 37*b* and 38*b* which are triggered by each input clock pulse applied to the sequential pulse generating circuit 47.

When the self-return type start/stop control switch 57*a* is again operated, the trigger input T of flip-flop circuit 60 is changed from logical 1 level to 0 level so that the output Q is switched from logical 1 level to 0 level. As a result, the output of inverter 63 becomes logical 1 level to render the output of OR gate 49 normally at logical 1 level. For this reason, the clock pulses of VCO 45 are not supplied to the sequential pulse generating circuit 47, disabling the automatic performance of arpeggio or the like. When the switch 57*a* is operated again, the output Q of flip-flop circuit 60 becomes logical 1 level so that the above-mentioned operations will be again repeated.

The operation when a quadruple time is set will be described. For setting the quadruple time, the switches 51*a* are enabled. The sequential pulse generating circuit 47 successively renders the outputs Q1 to Q8 at logical 1 level in response to the input clock pulses. When the output Q8 becomes logical 1 level, the sequential pulse generating circuit 47 is immediately cleared to make the output Q0 at logical 1 level. In the case of the quadruple time setting, the output Q6 is used as the gating pulse Q'6 and the output Q0 as Q'8. Eight sequential gate pulses successively and circulatingly enable the gate circuits $72_1$ to $72_8$ to couple sequentially and repeatedly the pitch voltages $V_1$ to $V_8$ to the tone signal generating circuit arrangement 32*a*.

The operation of sequencer in the manual mode will be described. For selection of the manual mode, the switches 56*a* and 56*b* are switched. The output of switch 56*b* becomes logical 1 level so that the flip-flop circuit 69 is forcibly reset to render the output Q at logical 0 level. This state is held irrespective of the level transition at the trigger input T. In other words, the manual mode selection is memorized by the flip-flop circuit 60. Since the output of switch 56*a* is at logical 0 level and the output of the one-shot multivibrator 64 is at logical 1 level, the output of NAND gate is at logical 1 level. As a result, VCO 45 is disabled. The output Q of flip-flop circuit 60 is at logical 0 level and hence the outputs of inverter 63 and OR gate 49 become logical 1 level. It is noted here that one of the inputs of NAND gate 50 that is connected to the OR gate 49 is logical 1 level. The input of the NAND gate 62 that is coupled with the switch 56*b* is at logical 1 level. The input of NAND gate 62 that is coupled with the start/stop control switch 57*a* becomes logical 1 level every time the switch 57*a* is operated. That is, the output of NAND gate 62 is switched from logical 1 level to 0 level every time the switch 57*a* is operated. As a result, the output of NAND gate 50 is switched from logical 0 level to 1 level for each operation of the switch 57*a*. Responsive to this positive transition of the output of NAND gate 50, the sequential pulse generating circuit 47 is manually advanced. At the manual advancing, which one of outputs of the sequential pulse generating circuit 47 is at logical 1 level, i.e., which one of gate circuits $72_1$ to $72_8$ is enabled, can be recognized by the indicators $86_1$ to $86_8$. That is to say, the gate circuit corresponding to the lighting indicator is now enabled. At this time, through adjustment of the potentiometer connected to the gate circuit being enabled, a desired pitch voltage can be set. From the foregoing, it will be understood that the start/stop control switch 57*a* also serves as a manual-advance switch.

The operation of the pitch voltage setting circuit 74 will be described below. If the output voltage of the operational amplifier 76 is $V_0$, the output voltage $V_1$ to $V_8$ of the potentiometers $75_1$ to $75_8$ will be expressed as follows:

$$V_1 = k_1 V_0$$
$$V_2 = k_2 V_0 = k_2/k_1 \times V_1$$
$$V_3 = k_3 V_0 = k_3/k_1 \times V_1$$
$$\vdots$$
$$V_8 = k_9 V_0 = k_8/k_1 \times V_1$$

where $k_1$ to $k_8$ represent coefficients determined by the slider positions of the potentiometers and each take a value falling within the range from 0 to 1. Due to a property of operational amplifier, input voltages at the noninverting and inverting inputs are equal to each other. Since no current flows through the feedback resistor 77, the input voltage KV applied to the noninverting input of operational amplifier 76 is equal to the output voltage of potentiometer $75_1$. That is, $KV = V_1$. Therefore, the output voltages of potentiometers $75_1$ to $75_8$ are given by $$V_1 = KV$$
$$V_2 = k_2/k_1 \times KV$$
$$\vdots$$
$$V_8 = k_8/k_1 \times KV$$

As seen from the above relations, the output voltage $V_1$ is equal to the magnitude of the KV signal from the keyboard circuit and the output voltages $V_2$ to $V_8$ are proportional to the magnitude of the KV signal applied to the noninverting input of operational amplifier 76. More particularly, the output voltages $V_2$ $V_8$ depend on the magnitude of the KV signal, the setting of the potentiometer $75_1$, and the settings of the corresponding potentiometers. Therefore, it will be understood that when the potentiometers $75_1$ to $75_8$ are once set, the memorized tones are modulated every time the magnitude of the KV signal coupled to the noninverting input of operational amplifier 76 is changed. For example, when pitch voltages corresponding to $C_2$, $E_2$, $G_2$ . . . are set by the potentiometers $75_1$ to $75_8$, if the KV signal corresponding to the note of $C_2$ is coupled, tones of $C_2$, $E_2$, $G_2$, . . . are successively sounded. Further, under the same settings of potentiometers, if the key of $C\#_2$ is depressed at the timing that the output pulse of Q1 is generated, tones $C\#_2$, $F_2$, $G\#_2$, . . . are successively sounded, When the slider potential of potentiometer $75_1$ becomes the ground potential, i.e., $k_1=0$, the operational amplifier 76 becomes inoperable and its output voltage rises up to a power source voltage of operational amplifier 76. However, since the tone sounded by the output voltage from potentiometer $75_1$ corresponds to the first beat tone of one- or two-measure unit of a musical composition, there is no case that the slider of potentiometer $75_1$ is coupled to the ground potential. The sliders of the other potentiometers may be coupled to the ground potential. In this case, no tone is memorized or set in the potentiometer whose slider is at the ground potential.

Since the first pulse Q1 during one cycle period of the sequential gating pulses is applied to the AND gate 82 connected to the sample/hold circuit 79, the sample/hold circuit 79 samples the KV signals from the keyboard circuit 31 at the timing of the first beat of one- or two-measure unit of a musical composition. Whether one- or two-measure unit is involved depends on the playing mode by a player. When the self-return switch 83 is closed, the AND gate 82 is disabled. Therefore, the sample/hold circuit 79 performs no sampling operation and continuously holds a previously sampled KV signal. When it is undesirable to memorize the KV signal corresponding to the first beat of one- or two-measure unit, the switch 83 is actuated by a player.

What we claim is:

1. An electronic musical instrument comprising:

a voltage-controlled tone signal generating circuit arrangement for generating a tone signal having a tone pitch which is determined by a voltage value of a signal applied thereto as its control signal;

clock pulse generating means for generating clock pulses;

sequential pulse generating means coupled to said clock pulse generating means for generating sequentially and circulatingly output pulses on outputs thereof;

pitch voltage signal setting means for setting a plurality of pitch voltage signals respectively having voltage values defining pitches of notes in a musical scale when supplied to said voltage-controlled tone signal generating circuit arrangement, said pitch voltage signal setting means being arranged such that said voltage values are respectively shifted, keeping a proportionality among the set voltage values, to deliver respectively corresponding output pitch voltage signals in accordance with a voltage value of a reference voltage signal applied thereto;

plural gate means having commonly connected outputs and coupled to said sequential pulse generating means and said pitch voltage signal setting means for transmitting said output pitch voltage signals sequentially and repeatedly to said commonly connected outputs of said plural gate means in response to the sequential output pulses of said sequential pulse generating means, said commonly connected outputs being coupled to said voltage controlled tone signal generating circuit arrangement; and selecting means for selectively providing one of plural voltage signals whose voltage values are different from each other to said pitch voltage setting means as the reference voltage signal.

2. An electronic musical instrument according to claim 1 wherein said pitch voltage signal setting means comprises an operational amplifier having an output and first and second inputs, said first input of said operational amplifier being coupled to said selecting means; and a plurality of potentiometers having respective bodies and sliders, said resistance bodies being connected in parallel between said output of said operational amplifier and a reference potential source, and said sliders being coupled to said plural gate means, respectively, the slider of one of said potentiometers being coupled to said second input of said operational amplifier.

3. An electronic musical instrument according to claim 1 wherein said selecting means includes a keyboard circuit having plural keys and arranged to provide a pitch determining voltage signal whose magnitude corresponds to the note of a depressed key, and a sample/hold circuit connected between said pitch voltage signal setting means and said keyboard circuit.

4. An electronic musical instrument according to claim 3 wherein said sample/hold circuit is connected to receive a predetermined one of the output pulses of said sequential pulse generating means as a sampling pulse.

5. An electronic musical instrument according to claim 4 further comprising manually operable means for preventing application of the sampling pulse to said sample/hold circuit.

6. An electronic musical instrument according to claim 1 further comprising a plurality of indicator means coupled to said sequential pulse generating means.

7. An electronic musical instrument according to claim 1 further comprising an auto/manual mode selection switch, an operation control switch, and circuit means responsive to the auto mode selection by said auto/manual mode selection switch and a subsequent operation of said clock pulse generating means to apply the clock pulses of said clock pulse generating means to said sequential pulse generating means, and responsive to the manual mode selection by said auto/manual mode selection switch and subsequent repetitive operations of said operation control switch to apply an advancing pulse to said sequential pulse generating means every time said operation control switch is operated.

8. An electronic musical instrument according to claim 7 wherein said operation control switch is of a self-return type.

9. An electronic musical instrument according to claim 7 further comprising auto mode indicator means coupled to said clock pulse generating to said auto/manual mode selection switch.

10. An electronic musical instrument according to claim 1 further comprising means connected to said sequential pulse generating means for causing said sequential pulse generating means to selectively generate on said outputs thereof sequentially and circulatingly output pulses the number of which is a multiple of 3 or 4.

11. An electronic musical instrument according to claim 1 wherein said voltage-controlled tone signal generating circuit arrangement includes means responsive to each input clock pulse applied to said sequential pulse generating means to produce a time-varying control waveform for controlling a tone signal being produced.

12. An electronic musical instrument comprising:

sequential pulse generating means for generating sequentially and circulatingly output pulses on outputs thereof;

plural gate means each having an input, output and control input, and arranged to be sequentially and circulatingly enabled by the sequential output pulses of said sequential pulse generating means respectively applied to said control inputs, said outputs of said plural gate means being connected commonly together;

a voltage-controlled tone signal generating circuit arrangement coupled to said commonly connected outputs of said plural gate means for producing a tone signal having a frequency corresponding to the magnitude of an output voltage signal on said commonly connected outputs of said plural gate means;

plural potentiometers each having a resistance body with first and second ends and a slider, the sliders of said plural potentiometers being coupled to said control inputs of said plural gate means, respectively, and said resistance bodies of said plural potentiometers being connected in parallel with each other with first ends of said parallel connected resistance bodies connected to a reference potential source;

an operational amplifier having an output and first and second inputs;

voltage signal providing means having an output for selectively providing one of plural voltage signals having different magnitudes;

first coupling means for coupling said output of said operational amplifier to second ends of said parallel connected resistance bodies of said potentiometers;

second coupling means for coupling the slider of one of said potentiometers to said first input of said operational amplifier; and third coupling means for coupling said output of said voltage signal providing means to said second input of said operational amplifier.

13. An electronic musical instrument according to claim 12 further comprising a fixed voltage source, and wherein said first coupling means includes selection switch means for selectively coupling said output of said operational amplifier and said fixed voltage source to said second ends of said resistance bodies of said potentiometers.

14. An electronic musical instrument according to claim 12 wherein said second coupling means includes a resistor.

15. An electronic musical instrument according to claim 12 wherein said third coupling means includes a sample/hold circuit.

16. An electronic musical instrument according to claim 12 wherein said voltage signal providing means includes a keyboard circuit for providing a pitch determining voltage signal having a magnitude corresponding to the note of a depressed key.

17. An electronic musical instrument according to claim 12 wherein said third coupling means includes a sample/hold circuit connected to receive a predetermined one of the output pulses of said sequential pulse generating means as a sampling pulse.

18. An electronic musical instrument comprising:

clock pulse generating means for generating clock pulses;

sequential pulse generating means responsive to application of input pulses thereto to produce output pulses on outputs thereof sequentially and circulatingly;

plural gate means each having an input, output and control input, and arranged to be sequentially and circulatingly enabled by the sequential output pulses of said sequential pulse generating means respectively applied to said control inputs, said outputs of said plural gate means being connected commonly together;

a voltage-controlled tone signal generating means coupled to said commonly connected outputs of said plural gate means and generating a tone signal having a tone pitch which is determined by a voltage value of a signal applied thereto as its control signal;

pitch voltage signal setting means for setting a plurality of pitch voltage signals respectively having voltage values defining pitches of notes in a musical scale when supplied to said voltage-controlled tone signal generating circuit arrangement, said pitch signals being coupled to said inputs of said plural gate means, respectively;

an auto/manual mode selection switch;

an operation control switch;

control circuit means coupled to said auto/manual mode selection switch, said operation control switch and said clock pulse generating means, and responsive to the auto mode selection by said auto/manual mode selection switch and a subsequent operation of said operation control switch to couple the clock pulses of said clock pulse generating means as input pulses to said sequential pulse generating means, and responsive to the manual mode selection by said auto/manual mode selection switch and subsequent repetitive operations of said operation control switch to couple an advance pulse as an input pulse to said sequential pulse generating means every time said operation control switch is operated.

19. An electronic musical instrument according to claim 18 wherein said control circuit means includes memory means for memorizing the manual mode selection by said auto/manual mode selection switch, and means responsive to an output state of said memory means representing the manual mode selection by said auto/manual mode selection switch to prevent application of output clock pulses of said clock pulse generating means to said sequential pulse generating means.

20. An electronic musical instrument according to claim 18 wherein said operation control switch is of a self-return type.

21. An electronic musical instrument comprising:

a keyboard circuit having a plural keys for providing a pitch determining voltage signal having a magnitude corresponding to the note of a depressed key;

a first voltage-controlled tone signal generating circuit arrangement connected to receive the pitch determining voltage signal from said keyboard circuit for producing a tone signal having a tone pitch corresponding to the depressed key;

sequencer means for providing sequentially and repeatedly a plurality of pitch voltage signals on an output thereof, said sequencer means being connected to receive the pitch determining voltage signal from said keyboard circuit and arranged such that the magnitudes of the pitch voltage signals on said output are a function of the pitch determining voltage signal from said keyboard circuit; and a second voltage-controlled tone signal generating circuit arrangement selectively connectable to said keyboard circuit and to said sequencer means.

22. An electronic musical instrument according to claim 21 wherein said sequencer means includes: clock pulse generating means; sequential pulse generating means coupled to said clock pulse generating means and responsive to clock pulses from said clock pulse generating means for producing sequentially and circulatingly on outputs thereof output pulses; plural gate means coupled to said sequential pulse generating circuit arrangement and each having an input, output and control input for transferring an input signal applied to said output in response to application of a corresponding one of output pulses of said sequential pulse generating means to said control input, said outputs of said plural gate means being connected commonly and being connected to said second voltage-controlled tone signal generating circuit arrangement; and means having a plurality of manually operable pitch voltage signal setting means for providing a plurality of pitch voltage signals to said inputs of said plural gate means, respectively, and arranged to make the magnitudes of the pitch voltage signals applied to said inputs of said plural gate means proportional to the magnitude of pitch determining voltage signal from said keyboard circuit, one of the pitch voltage signals having a magnitude substantially equal to the magnitude of the pitch determining voltage signal from said keyboard circuit.

* * * * *

UNITED STATES PATENT AND TRADEMARK OFFICE

CERTIFICATE OF CORRECTION

PATENT NO. : 4,206,676

DATED : June 10, 1980

INVENTOR(S) : Takeshi ADACHI et al

It is certified that error appears in the above—identified patent and that said Letters Patent is hereby corrected as shown below:

Column 12, line 49 (Claim 9), after "generating", insert --means and--;

Column 16, line 2 (Claim 22), after "commonly", insert --together--.

Signed and Sealed this

*Twenty-eighth* Day of *October 1980*

[SEAL]

*Attest:*

SIDNEY A. DIAMOND

*Attesting Officer*

*Commissioner of Patents and Trademarks*